US005673802A

United States Patent [19]

Valentino

[11] Patent Number: 5,673,802

[45] Date of Patent: Oct. 7, 1997

[54] ROTATABLE CAKE CANDLE HOLDER

[76] Inventor: George Valentino, 2667 Roackaway Ave., Oceanside, N.Y. 11572

[21] Appl. No.: 537,503

[22] Filed: Oct. 2, 1995

[51] Int. Cl.[6] ..... A47F 5/00

[52] U.S. Cl. ..... 211/70; 211/1.55; 84/95.1; 431/295; D11/184

[58] Field of Search ..... 211/115, 116, 211/163, 1.52, 1.53, 1.54, 1.55, 70; 84/95.1, 730, 731, 732; D11/184; 431/295

[56] References Cited

U.S. PATENT DOCUMENTS

| | | | |
|---|---|---|---|
| 735,010 | 7/1903 | Zahl | 211/1.53 |
| 3,308,705 | 3/1967 | Shinnick | D11/184 X |
| 3,819,455 | 6/1974 | MacKendrick | 431/295 X |
| 4,721,455 | 1/1988 | Barfus | 431/295 |
| 5,532,422 | 7/1996 | Chang | 84/95.1 |

*Primary Examiner*—Robert W. Gibson, Jr.
*Attorney, Agent, or Firm*—Grimes & Battersby

[57] ABSTRACT

A rotatable holder for a candle for a cake, said holder including a housing supporting an upstanding shaft having its upper end keyed within a complimentary recesses of a candle platform and a candle. Within the housing is a small, battery powered D.C. motor connected through reduction gearing to the shaft, and audio may be provided so that when rotating the shaft an appropriate melody can be played. The holder is fixedly secured to the cake by means of a plurality of prongs. A plurality of removable arms which receive commercially-available candles extends radially out from the platform and the base of the holder.

10 Claims, 1 Drawing Sheet

ROTATABLE CAKE CANDLE HOLDER

BACKGROUND OF THE INVENTION

1. Field of the Invention

The present invention relates to a rotatable cake candle holder and, more particularly, to such a candle holder that is battery powered and can play a number of different musical scores. The holder is adapted to be used in association with a holiday cake such as, for example, a birthday or anniversary cake.

Holiday cakes are often used to celebrate special occasions such as birthdays, anniversaries, weddings, confirmations and other special holidays and events. Frequently, such holiday cakes are decorated with either words or symbols applicable to the particular occasion, e.g., "Happy Birthday, Elisa." In many cases, candles are used to further decorate the holiday cake and, perhaps, indicate the age of the individual receiving the holiday cake. The candles and other decorations enhance the festive nature of the occasion. In addition, the holiday cake may serve as the centerpiece for the occasion and support songs or other merriment.

The incorporation of a rotatable candle holder on such a holiday cake could serve a number of functions. Obviously, it serves as a holder for at least one candle or other adornment. Being rotatable and electrically powered, it is able to rotate the candle or candles about the cake. The holder is also able to play a selection of different holiday songs selectable by the user.

2. Description of the Prior Art

The idea of providing a rotatable candle holder for holiday cakes which contains a music box is not new. See, for example, U.S. Pat. No. 3,308.705 which issued to R. V. Shinnick on Mar. 14, 1967 for a Cake Decorator. This patent describes a musical candle holder for cakes in which the music box movement is used to mechanically rotate a platform used to support a candle or candles around the cake.

Musical ornaments have also been utilized in the past in conjunction with holiday cakes. See, for example, U.S. Pat. No. 4,801,478 which issued on Jan. 31, 1989 to A. Greenblatt for a Musical Ornament for Celebrated Occasions.

Fixed candle holders for holiday cakes are also well known. See, for example, U.S. Pat. No. 2,468,505 which issued on Apr. 26, 1949 to A. G. McNeill for an Anniversary Cake Candleholder; U.S. Pat. No. 2,499,079 which issued on Feb. 28, 1950 to A. R. Steinhilb for a Candle Holder for Cakes; U.S. Pat. No. 3,767,355 which issued on Oct. 23, 1973 to D. B. Anderson, Jr. for a Candle Holding Device;; and U.S. Pat. No. 4,721,455 which issued on Jan. 26, 1988 to I. Barfus for a Birthday Cake Cover and Candle Holder. See also U.S. Pat. No. 243,781 which issued on Jul. 5, 1881 to John C. Koch is directed to a Revolving Cake and Fruit stand.

While each of these patents discuss the broad concept of supporting candles on a holiday cake with some even incorporating the elements of music and rotation, none provide an electrically powered cake candle holder that is not only capable of rotating the candle or candles around the cake for a relatively long period of time but can also play different musical scores to fit the occasion. As will be appreciated, none of these prior patents even address the problem faced by applicant let alone offer the solution proposed herein.

SUMMARY OF THE INVENTION

Against the foregoing background, it is a primary object of the present invention to provide a rotatable candle holder for holiday cakes adapted to hold at least one candle or other decoration.

It is another object of the present invention to provide such a candle holder that is electrically powered.

It is yet another object of the present invention to provide such a candle holder adapted to rotate the candles or other decoration about a holiday cake.

It is yet another object of the present invention to provide such a candle holder that is adapted to play a musical score.

It is yet still another object of the present invention to provide such a candle holder that permits the user to select different musical scores to fit the celebration.

It is another object of the present invention to provide such a candle holder that may be fixedly secured to the holiday cake.

To the accomplishments of the foregoing objects and advantages, the present invention, in brief summary, comprises a holder for rotating a cake decoration such as a candle or multiple candles, including a housing supporting an upstanding shaft. The shaft extends to an upper end portion which can mate within a complementary recess in the lower region of the cake decoration. Within the housing is provided a battery powered D.C. motor connected through respective reduction gears to the shaft for rotating the shaft upon energizing the motor. Preferably, the battery also energizes an audio device which will play a melody while the cake decoration rotates to enhance the party atmosphere of a celebration.

These and other objects, advantages and features of the present invention will become more apparent from the detail descriptions made below in conjunction with the accompanying drawings.

BRIEF DESCRIPTION OF THE DRAWING

The foregoing and still other objects and advantages of the present invention will be more apparent from the detailed explanation of the preferred embodiments of the invention in connection with the accompanying drawing, wherein.

DETAILED DESCRIPTION OF PREFERRED EMBODIMENT

Figure 1:
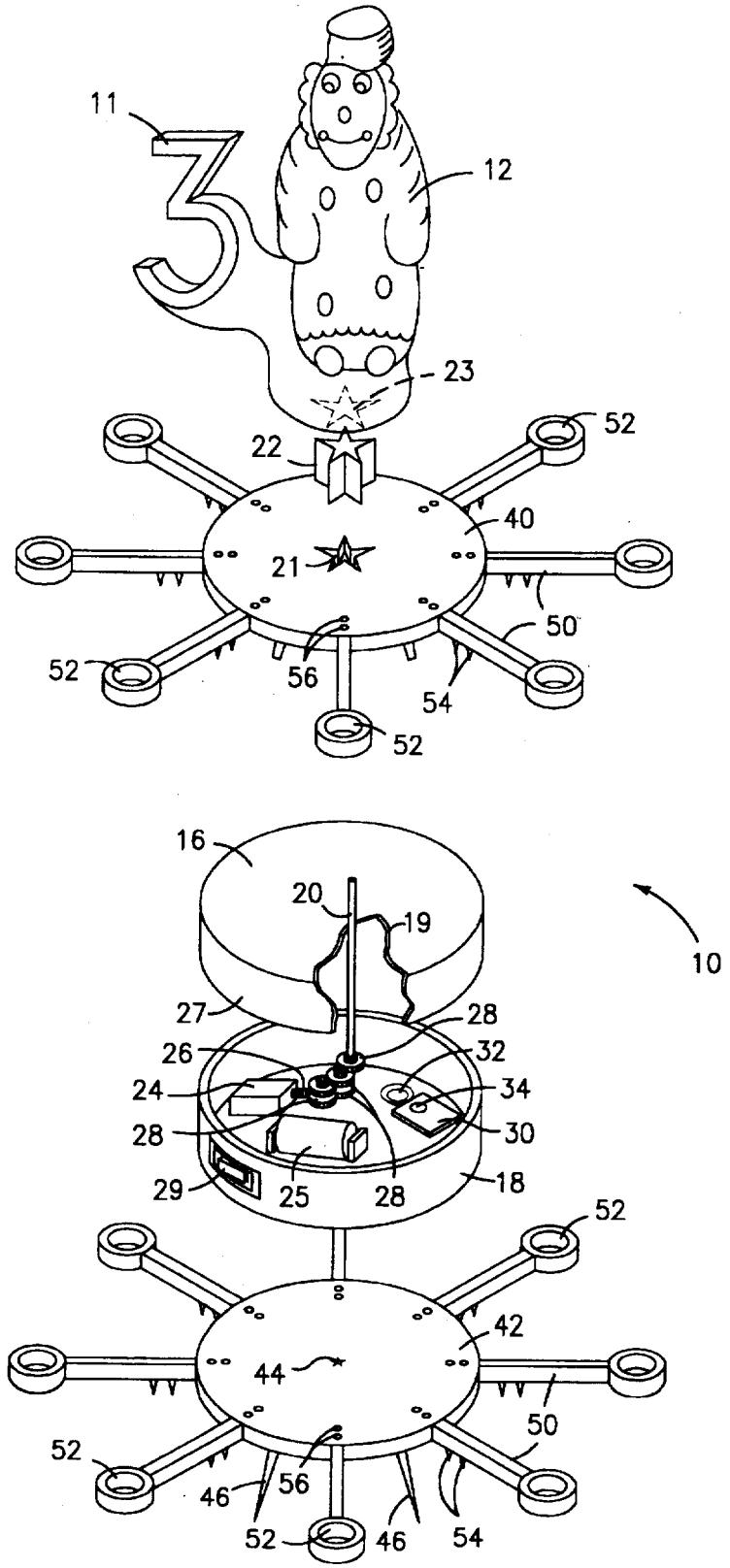
FIG. 1 is a partially exploded, perspective view of the rotatable candle holder of the present invention.

As illustrated in FIG. 1, a candle holder 10 for holiday cakes is provided. Candle holder 10 is adapted to accommodate and secure at least one candle platform 40 and at least one candle 12 which is mounted on candle platform 40. The candle 12 may be molded or shaped to represent a fanciful figure or other shape. Candle 12 may also include as integral therewith a numeral, i.e., the number "3" (as illustrated at 11) to represent the age of the person for whom the cake is to be given. In this way, the candle holder 10 of the present invention could be useful to celebrate the third birthday of a child. Of course, other candle shapes or configurations also could be envisioned such as the standard bride and groom decoration of a wedding cake with the numeral 50 to celebrate, for example, a fiftieth wedding anniversary of a couple. A key-shaped slot 23 is provided at the base of the candle 12 to assist in securing the candle 12 to the candle holder 10.

Regardless of the form or shape that the candle 12 may take, the candle holder 10 of the present invention includes a housing formed by a cover 16 positioned over a base 18. As illustrated, the cover 16 includes a central opening 19 through which an upstanding shaft 20 extends to an upper end portion carrying a key-shaped element 22 which is adapted to engage and secure the key-shaped hole 21 at the center of the candle platform 40 and the key-shaped slot 23 at the base of the candle 12. The key-shaped element 22 has a shape and dimension that is complementary to and adapted to fit snugly within the key-shaped hole 21 at the center of the candle platform 40 and the key-shaped slot 23 in the candle 12. The use of these key-shaped element 22 and slots 21, 23 serve to tightly secure the candle 12 and candle platform 40 to the holder 10 and prevent the candle 12 from toppling during operation.

The cover 16 fits over the base 18 which houses the operating components of the rotatable holder 10 that permit it to rotate the shaft 20. These operating components include a small DC motor 24 powered by a battery 25. The output shaft of the motor 24 is connected to a worm gear 26 which, through a series of reduction gears 28, rotates the shaft 20 upon energizing the motor 24. It is well known that small DC motors revolve at a very high RPM. As such, it is necessary to provide a series of reduction gears 28 to reduce the rotation speed of the candle 12 and the candle platform 40.

An on/off slide switch 29 is provided for actuating and de-actuating the motor and the decoration device and extends to the exterior surface of the housing. As can be understood, an access panel 27 is provided in the cover 16 to enable access to the switch 29 for activating the DC motor 24. Operation of the DC motor 24 by switch 29 permits rotation of the candle 12 and the candle platform 40.

The battery 25 serves to additionally energize the circuitry mounted on a printed circuit board 30 which includes a piezoelectric speaker 32 driven by an appropriate integrated circuit chip 34 to generate an audio response from the piezoelectric speaker. In a preferred embodiment, these integrated circuit chips 34 are interchangeable. As would, for example, be understood by those skilled in the art, when the decoration device 10 is intended for a birthday party the appropriate integrated circuit chip 34 for "Happy Birthday" is inserted and this song is played. If the user desires to change the song to, for example, "The Wedding Waltz," the appropriate chip 34 is inserted and replaces the original "Happy Birthday" chip. Thus, the holder is able to control the songs played by the candle holder 10 simply by changing the integrated circuit chip 34.

In an alternative embodiment (not shown), the integrated circuit chip 34 may be programmed to include a number of different songs with the user being able to select the appropriate track by manipulation of an external control switch (not shown).

Thus, when the on/off switch 29 is actuated, the candle 12 and candle platform 40 will begin to rotate and a digitalized song appropriate to the occasion will be played. The user may change the song by simply substituting a new IC chip 34. Due to the low drain on battery power, the candle 12 and candle platform may continue to rotate for hours.

The housing of the candle holder 10 is mounted upon a lower platform 42 which sits directly upon the cake and may be separated from the rest of the candle holder for easy cleaning. The lower platform 42 is secured to the cake by means of a plurality of prongs 46 which extend below the lower platform 42 and into the cake (not shown). Lower platform 42 engages the base 18 at a small finned protrusion (not shown) extending from the bottom of the base 18 which fits into a complementary-shaped finned hole 44 in the lower platform.

Both the lower platform 42 and the candle platform 40 are equipped with a plurality of candle arms 50 extending radially out from the perimeter of the platforms 40 and 42. Small commercially-available candles (not shown) may be seated within candle receptacles 52 located at the ends of the candle arms 50. Not shown is the fact that the length of the candle arms 50 extending from the candle platform 40 is shorter than the length of the candle arms 50 extending from the lower platform 42 so as to prevent entaglement of the said commercially-available candles. The candle arms 50 may be disengaged from the platforms 40 and 42. Subsequent to their removal, the candle arms 50 may be reattached to the platforms 40 and 42 by means of a set of pins 54 on the lower surface of the candle arms 50 that fit within a complementary-shaped set of holes 56 located on the surface of the platforms 40 and 42. In this way a variable number of candles may be attached to the candle holder 10 depending upon the occasion.

Having thus described the invention with particular reference to the preferred forms thereof, it will be obvious that various changes and modifications can be made therein without departing from the spirit and scope of the present invention as defined by the appended claims.

Wherefore, I claim:

1. A holder for at least one candle and at least one platform on a cake, said holder including:

means for causing said at least one candle and at least one platform to rotate about said cake, said means comprising a battery powered D.C. motor and a worm gear which are attached to said at least one candle by a drive shaft;

means for playing selected musical scores while said candle rotates about said cake; and means for securing said holder to said cake.

2. The holder of claim 1, wherein said means for causing further includes a series of reduction gears between the worm gear and the drive shaft to reduce the revolutions of the D.C. motor.

3. The holder of claim 1, wherein said drive shaft includes a key-shaped element at its end which is adapted to engage complementary key-shaped recesses in the said platform and at the base of said at least one candle.

4. The holder of claim 1, wherein said holder is powered by a battery which is actuated by an on/off switch.

5. The holder of claim 1, wherein said means for playing selected musical scores comprises at least one integrated circuit chip programmed to play a selected musical score through a piezoelectric speaker.

6. The holder of claim 5, wherein said integrated circuit chip is removable.

7. The holder of claim 5, wherein said integrated circuit chip is programmed to play a series of different musical scores, the particular score being selectable by a switch.

8. The holder of claim 1, wherein said means for securing comprises a plurality of prongs which extend into said cake.

9. A holder for at least one candle and at least one platform on a cake, said holder including:

means for causing said at least one candle and said at least one platform to rotate about said cake, said means for causing including a battery powered D.C. motor and a worm gear which are attached to said at least one candle and said at least one platform by a drive shaft;

means for playing selected musical scores while said candle and said platform rotates about said cake, said means for playing including an integrated circuit chip programmed to play a selected musical score through a piezoelectric speaker; and means for securing said holder to said cake.

10. A holder for at least one candle and at least one platform on a cake, said holder including:

means for causing said at least one candle and said at least one platform to rotate about said cake, said means for causing including a battery powered D.C. motor and a worm gear which are attached to said at least one candle and at least one platform by a drive shaft and further including a series of reduction gears to reduce the revolutions of the D.C. motor;

means for securing said at least one candle and said at least one platform to said drive shaft, said means for securing including a key-shaped element at an end of such drive shaft which is adapted to engage a complementary key-shaped recess at the base of the said at least one candle and the center of the said at least one platform; and means for playing selected musical scores while said candle and said platform rotates about said cake, said means for playing including an integrated circuit chip programmed to play a selected musical score through a piezoelectric speaker.

* * * * *